US008359698B1

(12) United States Patent
More

(10) Patent No.: US 8,359,698 B1
(45) Date of Patent: Jan. 29, 2013

(54) MOP SYSTEM

(76) Inventor: Norma More, Pembroke Pines, FL (US)

( * ) Notice: Subject to any disclaimer, the term of this patent is extended or adjusted under 35 U.S.C. 154(b) by 670 days.

(21) Appl. No.: 12/488,644

(22) Filed: Jun. 22, 2009

Related U.S. Application Data

(60) Provisional application No. 61/083,662, filed on Jul. 25, 2008.

(51) Int. Cl.
*A47L 13/20* (2006.01)

(52) U.S. Cl. ..... 15/228; 15/147.2; 15/231

(58) Field of Classification Search ..... 15/228, 15/143.1, 147.2, 231, 247
See application file for complete search history.

(56) References Cited

U.S. PATENT DOCUMENTS

| | | | | |
|---|---|---|---|---|
| 1,272,644 | A | 7/1918 | Ericksen | |
| 3,012,264 | A | 12/1961 | Nash | |
| 3,983,596 | A | 10/1976 | Siemund | |
| 4,047,260 | A | 9/1977 | Deutsch et al. | |
| 4,962,563 | A | 10/1990 | Bachar | |
| 5,343,587 | A | 9/1994 | Findley | |
| 5,655,250 | A * | 8/1997 | Warrell | 15/228 |
| 7,163,349 | B2 * | 1/2007 | Policicchio et al. | 401/137 |
| 7,307,055 | B2 * | 12/2007 | Cook et al. | 510/438 |
| 7,895,699 | B2 * | 3/2011 | Hutchins | 15/228 |

* cited by examiner

*Primary Examiner* — Shay Karls
(74) *Attorney, Agent, or Firm* — H. John Rizvi; Gold & Rizvi, P.A.

(57) ABSTRACT

An improved mop system and method is provided including a T-shaped handle and a mop head. The handle comprises an elongated cylindrical shaft with a crossbar perpendicularly attached at the base of the shaft.

The mop head comprises a sheet of flexible, absorbent first material and a sheet of flexible, reinforcing second material attached to a central area of the absorbent first material, with the joined absorbent first material and reinforcing second material configured with a generally circular central hole. The central hole is sized and shaped to accommodate the handle shaft, allowing the mop head to be fitted over the shaft and drawn down the shaft to be suspended over the crossbar.

Preferably the mop head also comprises a third material attached near one or both outer edges of the absorbent first material. Thus the improved mop system provides an easily removable, launderable, and re-installable mop head.

18 Claims, 2 Drawing Sheets

MOP SYSTEM

CROSS-REFERENCE TO RELATED APPLICATION

This Non-Provisional Application claims the benefit of U.S. Provisional Patent Application Ser. No. 61/083,662, filed on Jul. 25, 2008, which is incorporated herein in its entirety.

BACKGROUND OF THE INVENTION

1. Field of the Invention

The present invention relates generally to cleaning implement art, and more particularly, but not by way of limitation, to a manual T-shaped mop with an easily removable and launderable mop head configured for quick, efficient cleaning and changing of the mop head.

2. Description of the Prior Art

Mops are commonly used to manually wash, dry, or dust floors and/or other interior or exterior surfaces. Generally mops comprise a handle and a mop head, with the mop head being of a rag type or a sponge type. Normally the mop head is detachable from the mop handle to facilitate replacement of the old mop head alone, without the added cost of replacing the entire mop.

When using the mop to clean floors, the mop head naturally becomes dirty. Various methods of rinsing, wringing, reinstalling a laundered mop head, and replacing used or dirty mop heads are known.

Sponge mop heads are often difficult or complicated to replace. This type of mop head may have any of a wide variety of attachment mechanisms, often requiring several non-intuitive steps—such as requiring the removal or manipulation of small parts or requiring complicated techniques to release the old mop head and to re-engage a new mop head. Consequently removal of the used, dirty mop head is time-consuming. Plus the complicated structures for securing the mop head increase the expense of the mop and are prone to failure. Additionally, sponge mop heads are rarely machine washable, so cleaning the sponge mop head is limited to rinsing; therefore, the life of the sponge mop head is reduced and the degree of cleanness available is restricted. Replacement is an ongoing expense.

Rag mop heads, having the advantage of generally being launderable, are also attachable to the mop handle by a variety of means and methods. Some rag mop heads are attached by clamps or brackets, though commonly an absorbent fabric may simply be manually tied around the crossbar of a T-shaped handle. Or the absorbent fabric may simply be placed on the floor with the crossbar positioned in a generally central area and with a downward pressure applied to the crossbar from the shaft of the handle by the physical force of the user to hold the absorbent fabric on the floor and to move the absorbent fabric back and forth to wipe the floor. Each of these known methods of rag mop head attachment present a problem. The clamps or brackets add cost to the mop handle, increase the possibility of mechanical failure, and increase time and complexity to detach and to replace mop heads. Simply tying or draping the absorbent fabric over the crossbar of the T-shaped handle provides minimal anchoring, therefore the wet and dirty mop head is likely to slip off and need to be re-tied or re-draped several times during use. Merely pushing the absorbent fabric on the floor with the crossbar also results in lost time due to the continual repositioning necessary to secure the absorbent fabric with the downward pressure.

Another type of rag mop has a disposable fabric mop head, but the lack of an ability to launder the mop head increases waste, as the mop head must be disposed of in the trash, so is not ecologically or economically satisfactory.

Thus, while a variety of mops of both sponge type and rag type are conventionally available, existing mops have not been successful in fulfilling the desire for an economic, ecologically-friendly mop that is convenient and effective to use to clean floors and other surfaces, while having a mop head that is quick and easy to remove when soiled, to launder, and to reinstall as a fresh and clean mop head.

Accordingly, there is an established need for a practical, convenient, easy-to-use, and inexpensive improved mop capable of cleaning efficiently, while having an economical, ecologically-friendly mop head that is quick and easy to remove, to launder, and to reinstall.

SUMMARY OF THE INVENTION

The present invention is directed to an improved mop system and method, configured for convenient and effortless removal and replacement of the mop head to allow for easy laundering of the mop head. The improved mop system includes an elongated cylindrical shaft with a crossbar perpendicularly attached at the base of the shaft and a mop head. The mop head comprises a sheet of flexible, absorbent first material and a sheet of flexible, reinforcing second material. The second material is preferably attached to a central area of the absorbent first material, with the joined absorbent first material and reinforcing second material configured with a generally circular central hole. The central hole is sized and shaped to accommodate the handle shaft, allowing the mop head to be fitted over the shaft and drawn down the shaft to be suspended over the crossbar.

Preferably the mop head also comprises two opposing strips of a third material attached near the outer edges of the absorbent first material. Thus the improved mop system provides an economical mop with a removable, launderable, and re-installable mop head, which is convenient and effective to use to clean floors and other surfaces.

An object of the present invention is to provide an improved mop system that is effective in cleaning floors and other surfaces.

A further object of the present invention is to provide an improved mop system and an improved mop head that are inexpensive.

Another object of the present invention is to provide an improved mop system with an improved mop head that is quick and easy to remove and reinstall.

An additional object of the present invention is to provide an improved mop system with an improved mop head that is easily launderable.

Another object of the present invention is to provide an improved mop system with an improved mop head that is sturdy and long-lasting.

These and other objects, features, and advantages of the present invention will become more readily apparent from the attached drawings and from the detailed description of the preferred embodiments, which follow.

BRIEF DESCRIPTION OF THE DRAWINGS

The preferred embodiments of the invention will hereinafter be described in conjunction with the appended drawings, provided to illustrate and not to limit the invention, where like designations denote like elements, and in which.

Like reference numerals refer to like parts throughout the several views of the drawings.

DETAILED DESCRIPTION OF THE PREFERRED EMBODIMENTS

Shown throughout the figures, the present invention is directed toward an improved mop system with an improved mop head and method of use. The mop system is designed for effective cleaning, plus convenient removal, easy laundering, and effortless reinstallation of the long-lasting mop head.

Figure 1:
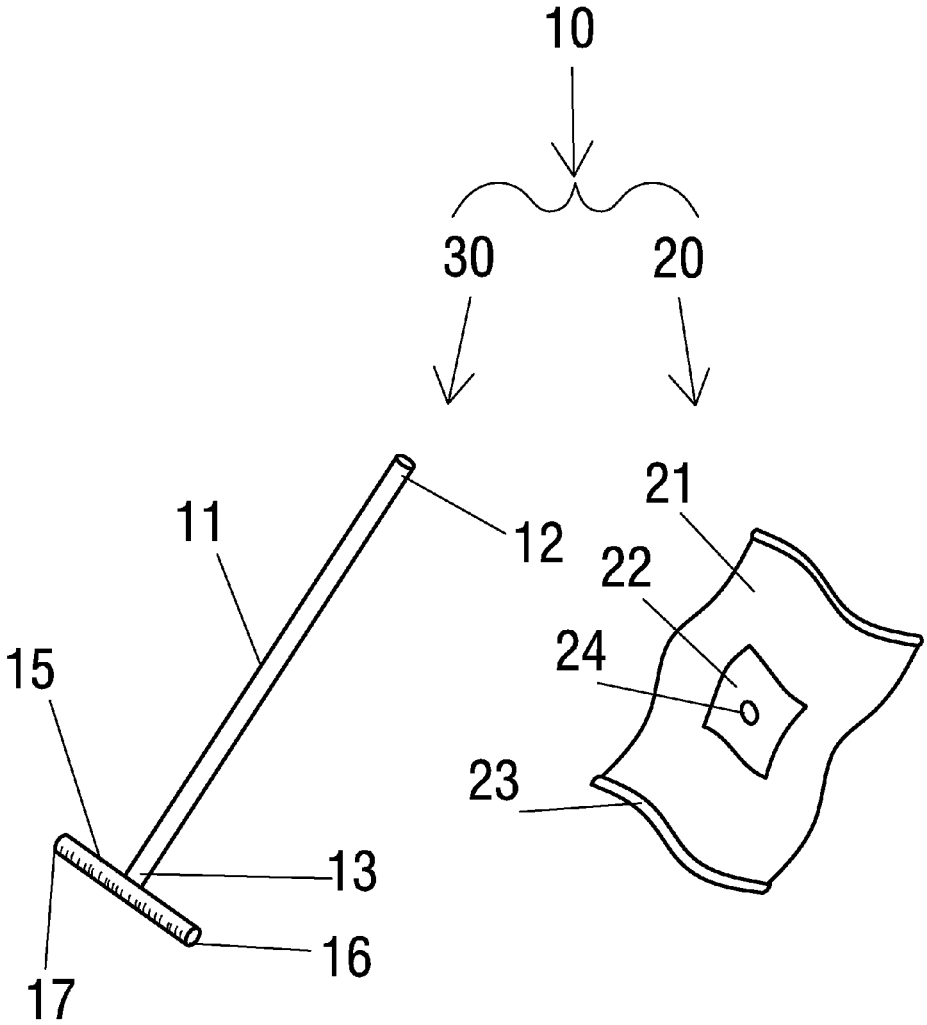
FIG. 1 is a perspective view showing a preferred embodiment of the improved mop system of the present invention with the mop head unattached from the handle.
Figure 2:
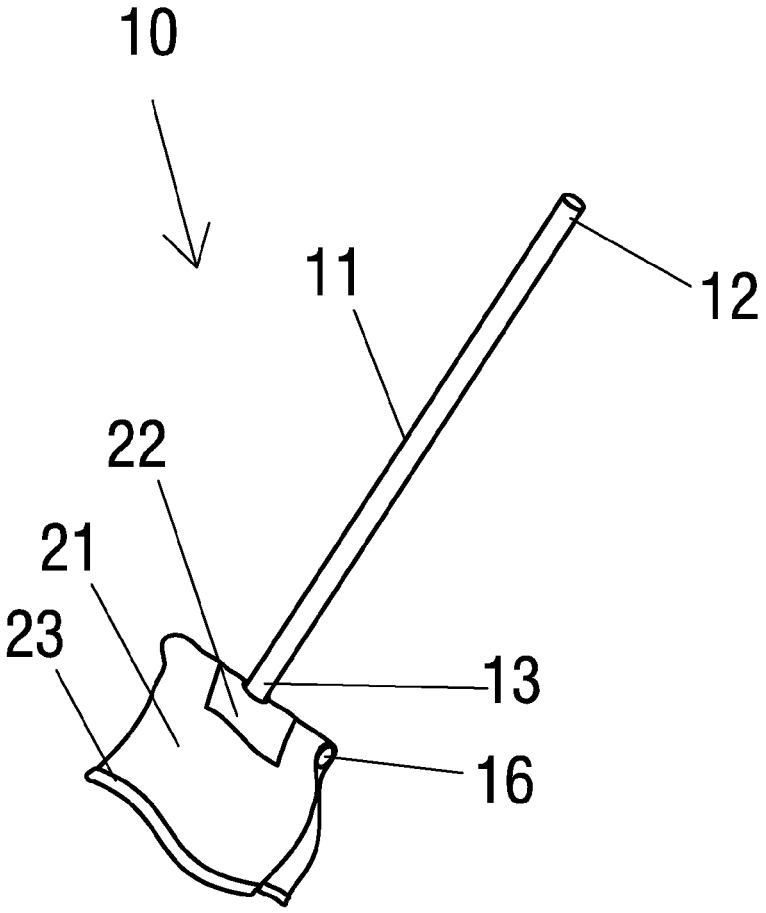
FIG. 2 is a perspective view showing a preferred embodiment of the improved mop system of the present invention with the mop head fitted over the handle in the operational position.

Referring now to FIG. 1, an improved mop system, shown generally as reference number 10, is illustrated in accordance with a preferred embodiment of the present invention. As shown, the improved mop system 10 includes a mop head 20 and a T-shaped handle 30. Handle 30 comprises an elongated cylindrical shaft 11 and a cross member or crossbar 15.

The shaft 11 is configured as an elongated, preferably cylindrical rod with a base end 13 and an opposing grip end 12. The length of shaft 11 is sufficient to allow the user to conveniently and comfortably mop floors. The diameter of shaft 11 is preferably sized to be comfortable in the user's hands. Grip end 12 of shaft 11 may optionally be configured with indentations, recesses, or protrusions adapted for comfort of the user (not shown). Shaft 11 is preferably formed of wood, although shaft 11 may alternatively be formed of metal or synthetic materials, such as plastic.

The crossbar 15 is perpendicularly attached at the base 13 of shaft 11, and is preferably cylindrically shaped. Crossbar 15 is preferably formed of wood, although it may alternatively be formed of metal or synthetic materials, such as plastic. Preferably crossbar 15 is permanently affixed to base 13, although a removable crossbar 15, such as might be desirable for compact storage, is within the scope of the invention. If a removable crossbar 15 is desired, conventional fittings, such as complementary screw threads are provided.

Mop head 20 comprises a first sheet 21 of a flexible, absorbent material and a second sheet 22 of a flexible, reinforcing material. The second reinforcing sheet 22 is preferably somewhat smaller than the first sheet 21. The second reinforcing sheet 22 is attached to a central area of the first absorbent sheet 21 to reinforce this central area. The second reinforcing sheet 22 is preferably attached to the first absorbent sheet 21 by sewing the two together, although the two may be alternatively joined by an adhesive or other permanent attachment method. The joined first absorbent sheet 21 and second reinforcing sheet 22 are configured with a generally circular central hole 24 sized and shaped to accommodate the shaft 11, allowing the insertion of the shaft 11 into central hole 24 in such a manner that the mop head 20 can be drawn down handle shaft 11 to be suspended over the handle crossbar 15 at shaft base 13. Central hole 24 may optionally be reinforced by additional stitching 19 using a sufficiently durable thread or filament. One exemplary pattern of stitching is shown in FIG. 1, but any one of numerous patterns can be used, such as, for example, concentric circles, aesthetically pleasing patterns, geometric-based patterns, floral-based patterns, and the like.

The first absorbent sheet 21 may be any woven or non-woven, natural or manmade fabric having a sufficient degree of absorbency to soak up an amount of water sufficient for mopping, such as, for example, cotton, rayon, wool, synthetic chamois cloth, microfiber, or other natural or manmade fibers. The first absorbent sheet 21 is most preferably a length of cotton terrycloth-type fabric. The width of the absorbent first absorbent sheet 21 is generally similar to the length of crossbar 15. Most preferably the width of first absorbent sheet 21 is slightly larger than the length of crossbar 15, so that the first absorbent sheet 21 extends slightly beyond first crossbar end 16 to slightly beyond the opposing second crossbar end 17. The length of the absorbent first absorbent sheet 21 is sufficient to extend over crossbar 15 when the mop head 20 is suspended over crossbar 15. For example, the length of the first material sheet may be around 15 to 50 inches.

The second reinforcing sheet 22 may be any woven or non-woven natural or manmade fabric characterized by a degree of sturdiness sufficient to somewhat strengthen and/or provide durability to the central area. The second reinforcing sheet 22 is most preferably a sturdy woven cotton material.

Optionally, but preferably, the improved mop system 10 comprises a third sheet 23 of flexible material attached as a strip near or at a first outer edge of the absorbent first material 21. The material comprising the third sheet 23 differs from the material of the first absorbent sheet 21 and the second reinforcing sheet 22. The material of third sheet 23 may absorbent material (characterized by an increased degree of absorbency, or, alternatively, the material of third sheet 23 may be characterized by a degree of abrasiveness or roughness, thereby enhancing the cleaning and scrubbing ability of the mop head 20.

A fourth sheet 14 is optionally, but preferably, included. The fourth sheet 14 is attached as a strip near or at the opposing second outer edge of the absorbent first material 21, similarly to the third sheet 23. The fourth sheet 14 may be of the same material as the third sheet 23 or may be of a fourth material. For instance, if the third sheet 23 is of a scrubbing material, the fourth sheet 14 may be of a particularly absorbent material.

The third sheet 23 and/or fourth sheet 14 may be sewn or otherwise attached onto a section of the absorbent first material 21 near one or both forward and backward extending edges or may be sewn onto, and extend outward from one or both extending edges of the absorbent first material 21.

To use the improved mop system 10, the user fits the central hole 24 of mop head 20 over the grip end 12 of handle shaft 11. Grip end 12 is inserted through central hole 24. Shaft 11 is drawn through central hole 24 while the mop head 20 descends down shaft 11 until reaching handle crossbar 15. Mop head 20 is retained by handle crossbar 15 and is draped or suspended over crossbar 15. Mop head 20 is now in a usable position with a portion of the mop head 20 forward of crossbar 15 and a portion rearward of crossbar 14. The particular operation to be performed dictates the next step. For example, if the floor is to be mopped, the user holds grip end 12 of shaft 11 and dips mop head 20 into water. Optionally, wringing of a portion of the water in mop head 20 may be performed, either manually or by mechanical means. Then mop head 20 is positioned on the floor and is drawn back and forth across the floor to wet and/or to clean the floor. If mop head 20 becomes dirty, the user may remove the dirty mop head 20 by reversing the steps and replace it with a clean, laundered mop head 20. Or, optionally, while the dirty mop head 20 remains attached to handle 30, the user may choose to rinse the dirty mop head 20 in water, such as by dipping the mop head 20 into a container of water and wringing out the excess water.

Alternatively, the particular operation of interest may be to dry the floor, for example, after wet mopping or after a spill.

If a wet or dirty used mop head 20 is still suspended over crossbar 15 (for example, after freshly wet mopping the floor), the used mop head 20 is drawn upward from base 13 toward grip end 12 of shaft 11 and removed from the end of shaft 11. Then a new mop head is positioned over the grip end 12. Grip end 12 is inserted into central hole 24, and mop head 20 is drawn down shaft 11 to rest on crossbar 15. Then mop head 20 is manually drawn back and forth across the floor to dry the floor.

The mop head 20 of the current invention is easily removable from a T-shaped mop handle 30 and is easily re-installable, thus promoting cleanliness. Also, it is easily launderable and reusable, so is environmentally friendly, as it reduces landfill waste compared to disposable products. Further, the improved mop head 20 is inexpensive, yet it is long-lasting.

Since many modifications, variations, and changes in detail can be made to the described preferred embodiments of the invention, it is intended that all matters in the foregoing description and shown in the accompanying drawings be interpreted as illustrative and not in a limiting sense. Thus, the scope of the invention should be determined by the appended claims and their legal equivalents.

I claim:

1. An improved mop system comprising:

a handle comprising an elongated generally cylindrical shaft having a base end and an opposing grip end, said handle also comprising a generally cylindrical crossbar fixedly attached substantially perpendicularly to said base end of said shaft; and a mop head comprising a first sheet of flexible, absorbent material and a second sheet of flexible, reinforcing material attached to a central area of said first sheet, said second sheet having a width less than the width of said first sheet and having a length less than one half the length of said first sheet; wherein the joined first sheet and second sheet are configured with a generally circular central hole sized to accommodate said shaft in such a manner that said mop head can be suspended over, and restrained by, said crossbar at said shaft base end; and wherein said absorbent first sheet and said reinforcing second sheet are configured with reinforcing stitching disposed around said circular central hole, wherein said reinforcing stitching is configured to secure said first sheet to said second sheet.

2. The improved mop system, as recited in claim 1, wherein said mop head further comprises a third sheet of flexible third material sewn as a strip along a first outer edge of said first sheet.

3. The improved mop system, as recited in claim 2, wherein said mop head further comprises a fourth sheet of flexible fourth material sewn as a strip along a second outer edge of said first sheet.

4. The improved mop system, as recited in claim 3, wherein said third sheet comprises an absorbent material and said fourth sheet comprises an absorbent material.

5. The improved mop system, as recited in claim 3, wherein said third sheet comprises a scrubbing material and said fourth sheet comprises a scrubbing material.

6. The improved mop system, as recited in claim 3, wherein said third sheet comprises an absorbent material and said fourth sheet comprises a scrubbing material.

7. The improved mop system, as recited in claim 3, wherein said absorbent first sheet and said reinforcing second sheet are configured with additional reinforcing stitching generally around said circular central hole.

8. The improved mop system, as recited in claim 3, wherein said first sheet comprises a terry cloth fabric.

9. The improved mop system, as recited in claim 3, wherein said terry cloth fabric is fabricated of cotton.

10. The improved mop system, as recited in claim 3, wherein said second sheet comprises a woven cotton cloth.

11. An improved mop head for use with a T-shaped mop handle comprising:

a first sheet of flexible, absorbent material;

a second sheet of flexible, reinforcing material, sized significantly smaller than said first sheet disposed in a central area of said absorbent first sheet, wherein the joined said first sheet and said second sheet are configured with a generally circular central hole sized and configured to allow the insertion of said shaft into said central hole in such a manner that said mop head can be suspended over, and restrained by, said crossbar at said shaft base end; and a third sheet of flexible material disposed on a first outer edge of said first sheet.

12. The improved mop head for use with a T-shaped mop handle, as recited in claim 11, further comprising a fourth sheet of flexible material disposed on a second outer edge of said first sheet.

13. The improved mop head for use with a T-shaped mop handle, as recited in claim 12, wherein said third sheet comprises an absorbent material and said fourth sheet comprises an absorbent material.

14. The improved mop head for use with a T-shaped mop handle, as recited in claim 12, wherein said third sheet comprises a scrubbing material and said fourth sheet comprises a scrubbing material.

15. The improved mop head for use with a T-shaped mop handle, as recited in claim 12, wherein said third sheet comprises an absorbent material and said fourth sheet comprises a scrubbing material.

16. The improved mop head for use with a T-shaped mop handle, as recited in claim 12, wherein said absorbent first sheet and said reinforcing second sheet are configured with additional reinforcing stitching in an area around said circular central hole.

17. The improved mop head for use with a T-shaped mop handle, as recited in claim 12, wherein said first sheet comprises a cotton terry cloth fabric.

18. The improved mop head for use with a T-shaped mop handle, as recited in claim 12, wherein said second sheet comprises a woven cotton cloth.

* * * * *